US007512997B2

(12) United States Patent
Dewees

(10) Patent No.: US 7,512,997 B2
(45) Date of Patent: Apr. 7, 2009

(54) SHOWER CURTAIN BAR

(76) Inventor: John S. Dewees, 36 Symor Dr., Morristown, NJ (US) 07960

( * ) Notice: Subject to any disclaimer, the term of this patent is extended or adjusted under 35 U.S.C. 154(b) by 146 days.

(21) Appl. No.: 11/216,286

(22) Filed: Aug. 31, 2005

(65) Prior Publication Data

US 2006/0096022 A1 May 11, 2006

Related U.S. Application Data

(60) Provisional application No. 60/625,852, filed on Nov. 8, 2004.

(51) Int. Cl.
*A47K 3/00* (2006.01)

(52) U.S. Cl. ..... 4/610; 4/608; 4/558; 211/105.2; 248/264

(58) Field of Classification Search ..... 4/605, 4/609, 610, 557, 558, 607, 608; 211/105.1, 211/105.2, 105.3; 248/261, 262, 264, 265; 160/352
See application file for complete search history.

(56) References Cited

U.S. PATENT DOCUMENTS 2,195,979 A 4/1940 Ziolkowski
2,261,142 A * 11/1941 Davis ..... 160/330
2,778,030 A 1/1957 Goche
4,496,059 A 1/1985 Leiter
4,775,056 A * 10/1988 Inglis ..... 211/105.3
5,538,364 A * 7/1996 Huntsman ..... 405/288
D397,928 S 9/1998 Wise
D426,142 S 6/2000 Moore
6,216,287 B1 4/2001 Wise
6,263,523 B1 7/2001 Moore

OTHER PUBLICATIONS

International Search Report/Written Opinion for PCT/US05/40016.

* cited by examiner

*Primary Examiner*—Huyen Le
(74) *Attorney, Agent, or Firm*—Douglas J. Ryder; Ryder IP Law, PC

(57) ABSTRACT

In some embodiments an apparatus to hold shower curtains is disclosed. The apparatus includes a shower bar and mounting brackets. The mounting brackets are connected to at least one wall to receive the shower bar. The shower bar may be made of a flexible material that has a rectangular cross section and a rounded upper edge. The rectangular cross section enables the shower curtains to lay flat on the bar. The flexible material may enable the shower bar to be flexed during installation or to absorb contact from an object. Other embodiments are otherwise disclosed herein.

13 Claims, 13 Drawing Sheets

SHOWER CURTAIN BAR

PRIORITY

This application claims the priority under 35 USC §119 of Provisional Application 60/625,852 entitled "Shower Curtain Bar" filed on Nov. 8, 2004 and having John S. DeWees as an inventor. Application 60/625,852 is herein incorporated by reference in its entirety but is not prior art.

BACKGROUND

Shower curtains, like shower doors, are used to hold water from a shower within a shower enclosure (e.g., shower stall, tub). Typically a shower rod is used to hold the shower curtains. The shower rod, as the name would suggest, is a cylindrical tube having a circular cross section. The shower rod extends across an opening in the shower enclosure. The shower rod may be permanently affixed to the shower enclosure walls using some type of mount. Alternatively the shower rod could be designed to provide tension so that it may be temporarily affixed to the walls. The tension may be provided by a spring bracket or other means. The shower curtains are hung on the rods typically with hooks. The hooks slide on the rod and the shower curtain moves with the hooks.

A problem with the typical shower rod is that the cylindrical shape may make it apt to rotate either within the mount or on the wall. Due to the construction of the typical rod and the circular cross section there is typically little or no flexibility in the rod. Accordingly, if a door was opened and hit the rod the rod would not give and the round cross section of the typical rod can mar the door. Moreover, the impact of the door opening can effect the integrity of the rod or the mounting of the rod. For example, a spring tension rod may fall if enough tension is lost when the rod either is moved or rotates when hit by a door. Additionally, the mounts used to hold the rod may loosen as they absorb the shock of a door hitting the rod.

The limited flexibility also makes installation of the rod more complicated as the rod can not be flexed to fit into a mount. Another problem with installation of a rod is that due to the circular cross section the edge of the rod needs to be parallel to the wall or receiving portion of the mount. If the walls are not parallel or if the rod or mounts are not installed level the edge may not be parallel and portions of the edge may not be in contact with the wall or mount. For a spring loaded rod this may result is less surface area providing the tension and a less stable connection. In addition, a rod can not easily be installed in shower enclosures not having two parallel walls due to the circular cross section. That is, the mount and the edge of the rod need to be at the same angle so that the mount can receive the rod. For a spring loaded rod, the edge would have to be formed to have a specific angle that aligned with the walls.

Additionally, a rod can not easily be formed to other shapes that may be desirable. For example, it may be desirable to have a shower rod that traced the curvature of a tub. However, due to the circular cross section of the rod the rod would require straight ends surrounding a curved portion so that he rod could be received by a mount. Such a configuration of different portions is not desirable and may not be ascetically pleasing. Additionally, if the rod needed to be shortened or the amount of arc needed to be reduced it would require cuts to each end of the rod so as to maintain the arc in the middle. Moreover, unless the straight portions were of significant length, the length of the curved rod could not be shortened too much without eliminating the straight portions.

Furthermore, using a shower rod doesn't allow a curtain to lay flat. Rather, if the shower curtain is placed directly on the rod the roundness of the rod will show through the curtain. If hooks are used the curtain may be folded or pleated where the hooks are located. Moreover, the round cross section may cause friction with some fastening systems.

Accordingly, there is need for an apparatus to hang shower curtains that is not apt to rotate, is flexible, does not require an edge to be parallel to the wall or mount it is to be installed on, can be formed to different shapes and or sizes, can easily be modified and provides an aesthetically pleasing look (e.g., allows the curtain to lay flat).

SUMMARY

A shower curtain bar is provided to hold shower curtains. The shower bar has a rectangular cross section with a flat front face. The rectangular cross section means that the bar is not apt to rotate. The flat front face helps prevent doors from being marred as they make contact with the bar. The shower bar may be made of a flexible but strong material so that the bar can be twisted to aid in installation and support the weight of the shower curtains. For example, the exact formation of the bar can change to support installations that are not exactly in accordance with specifications (e.g., non parallel walls). The flexibility may also absorb contact from a door. Mounting brackets may be used to support the bar. The brackets may be formed as mirror images of one another so only a single fabrication is required. The mounting brackets have a groove formed therein for receiving the bar. The grove may be larger than the bar to provide additional flexibility in installation. The mounting brackets may be mounted to the walls using screws that can be inserted into holes that are formed therethrough. The mounting bracket may include a set screw that can be used to help hold the bar in place.

According to one embodiment, the shower bar may be curved for certain installations. For example, for shower stalls that only have one or two walls the shower bar may be curved so as to form a stall for an individual to shower within. According to one embodiment, the shower bar may be curved (arced) to follow an arc of a tub (e.g., edge between tub portion and platform portion). The curved showed bar enables a shower curtain hanging therefrom to drape within the outer edge of the bathtub thus keeping the water within the tub while at the same time providing use of the entire tub. The curved shower bar has a particular arc and depth to it depending on the specifications of the tub that it is used with. The arc and depth can be modified by cutting a single edge of the bar.

The shower bar can be used with shower curtains that use hooks or with Hookless® shower curtains, such as those described in U.S. Pat. No. 5,186,232. The shower bar enables the shower curtains to lay flat against the bar. The shower bar may include designs on the face of it.

BRIEF DESCRIPTION OF THE DRAWINGS

The features and advantages of the various embodiments will become apparent from the following detailed description in which.

DETAILED DESCRIPTION

Figure 1A:
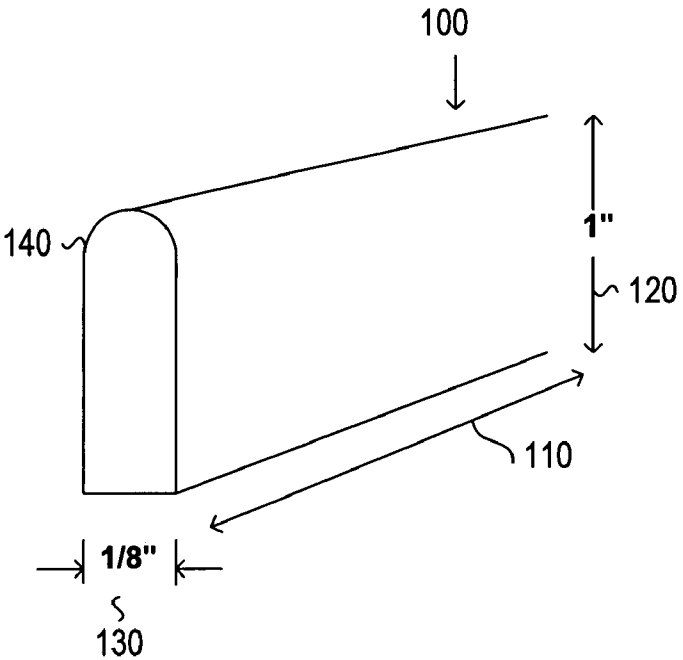
FIGS. 1A-B illustrate perspective and cross-sectional views of an example shower bar, according to one embodiment.

FIG. 1A illustrates a perspective view of an exemplary shower bar 100. The bar 100 has a rectangular cross section that eliminates problems associated with rotation in standard shower rods that have circular cross sections. Moreover, the rectangular cross section provides a flat exterior surface that may prevent damage (marring) to a bathroom door if it hits the shower bar 100.

The bar 100 has a length 110, a height 120 and a width (depth) 130 associated with it. The length 110 is dictated by size of space that it is to be installed in (e.g., size of opening of shower enclosure). The height 120 and the depth 130 of the bar 100 may be selected so as to provide the necessary support as well as an aesthetically pleasing look. It should be noted that it is possible that the height 120 and depth 130 may vary based on the length 110 of the bar 100. According to one embodiment, a top edge 140 of the bar 100 may be rounded. The rounded edge 140 may provide an aesthetic look as well as to provide a smooth surface for a shower curtain to slide on. As illustrated, the exemplary shower bar 100 has a height 120 of 1 inch and a depth 130 of $\frac{1}{8}^{th}$ inch. However, the bar 100 is in no way intended to be limited by the illustrated dimensions as variations of these parameters are well within the scope of the current invention.

Figure 1B:
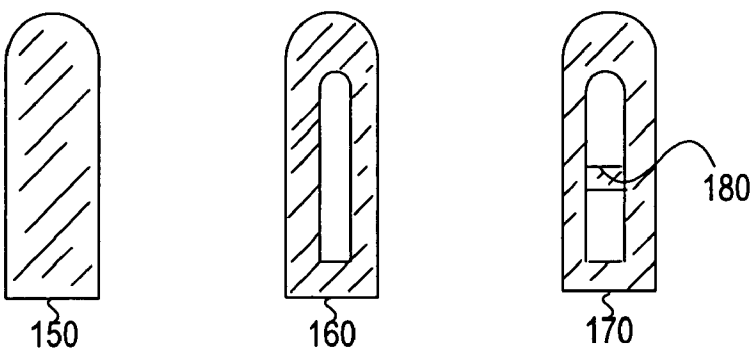

FIG. 1B illustrates a cross-sectional view of the bar 100. The bar 100 may be solid 150 in order to provide the necessary support or may be solid because the height and/or depth are relatively small and having a solid bar is most feasible and practical. According to alternative embodiments, the bar may be hollow 160 or partially hollow 170 (hollow but with supports 180 to provide more support or rigidity). The supports 180 in the partially hollow bar 170 may extend horizontally, vertically, diagonally or some combination thereof (illustrated as being horizontal). The type of cross section that is used depends on several factors including at least some subset of the dimensions (e.g. thickness) of the bar 100, the material used in making the bar 100, and how flexible the bar 100 is.

The bar 100 may be made of a light weight material. The bar 100 may be made of a relatively strong material that can support the weight of shower curtains as well as possibly a shower liner. The bar 100 may be made of a flexible material to allow the bar to be flexed during installation to make installation easier. The bar 100 may also flex when a door bangs into the bar 100 so as to not damage the door or the bar 100. That is, the flexibility in the bar enables the bar to flex in so not to damage the bar 100 or the object hitting the bar and to not put undue stress on the components holding the bar 100 (e.g., act as a safety bumper). The bar 100 may be made of a material that can be cut (e.g., with a hack saw) if the length of the bar 100 needs to be shortened.

The bar 100 may be formed by molding (e.g., extrusion, injection, poured). The material may be an aluminum material such as a variation of the 6000 series of aluminum. According to one embodiment, the bar 100 may be made of solid 6021 aircraft aluminum that provides a flexible but yet strong bar 100. The material may be plastic (e.g., PVC, acrylic, ABS). Alternatively, the bar 100 may be stamped or may be machined. The bar 100 may have an anodized finish applied to provide enhanced exterior rigidity.

Figure 2:
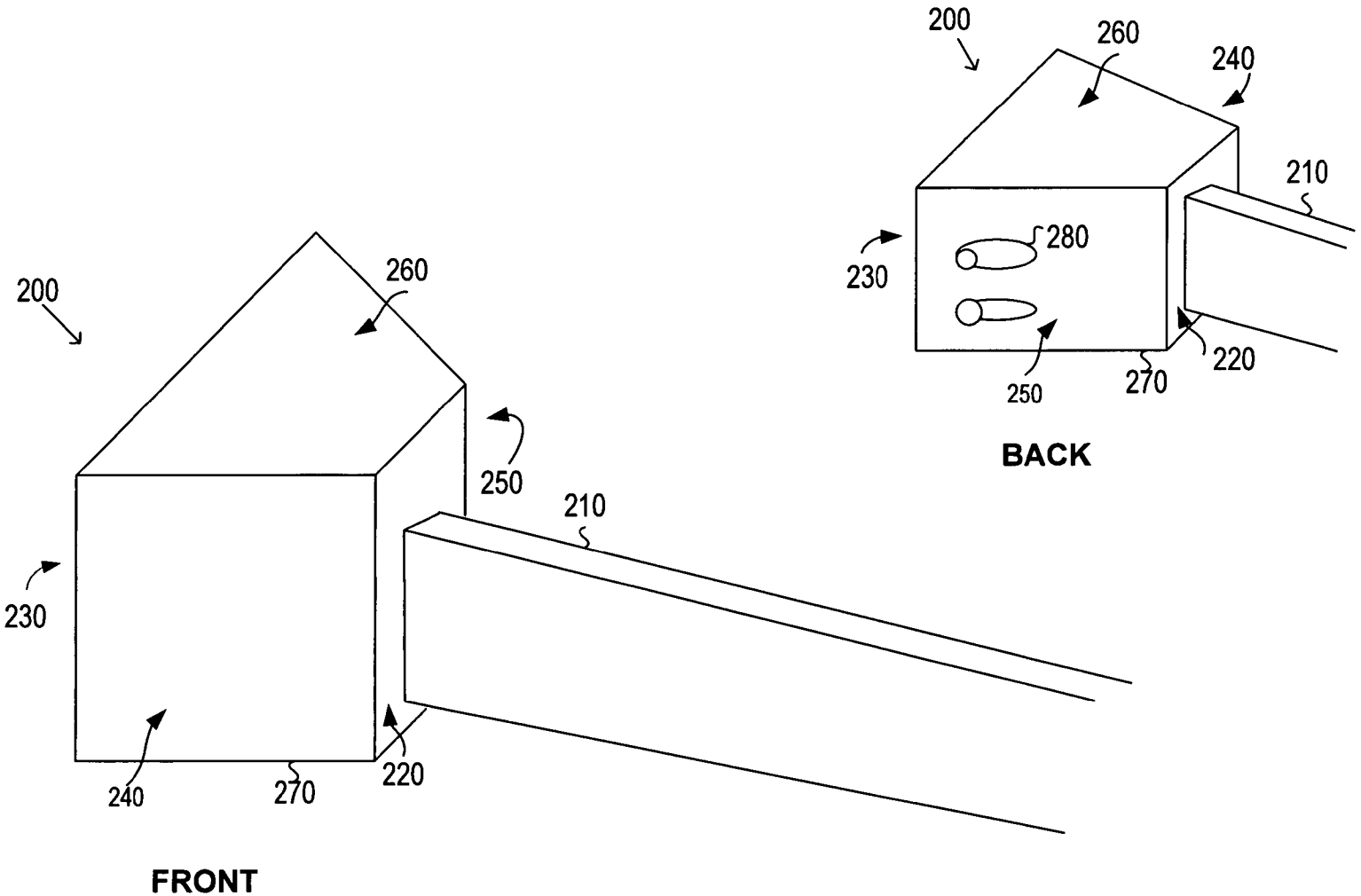
FIG. 2 illustrates a front and back perspective view of an example mounting bracket receiving a shower curtain bar, according to one embodiment.

FIG. 2 illustrates a front and back perspective view of an example mounting bracket 200 receiving a shower curtain bar 210 (e.g., 100). The mounting bracket 200 may include a receiving face 220, a mounting face 230, an exterior (front) face 240, an interior (inner) face 250, an upper face 260 and a lower face 270. The receiving face 220 includes a groove (hidden by bar 210 as illustrated) formed therein for receiving the bar 210. The mounting face 230 abuts against a wall (e.g., sidewalls of the shower/tub) and provides a connection between the mounting bracket 200 and the wall. According to one embodiment, the mounting bracket 200 may be screwed to the wall. Accordingly, the mounting bracket 200 may include hole(s) 280 for allowing screws to pass therethrough and secure the mounting bracket 200 to the wall. The holes 280 may extend from the inner face 250 through the mounting bracket 200 and exit the mounting face 230.

The receiving face 220 and the mounting face 230 may be parallel to one another. The upper and lower faces 260, 270 may be parallel to one another. The front face 240 may be perpendicular to the receiving face 220 and the mounting face 230. The mounting face 230 may be longer that the receiving face 220. The interior face 250 may be angled to connect an inner edge of the receiving face 220 to an inner edge of the mounting face 230. The holes 280 may be formed on the angled interior face 250 so that as to be closer to the wall. However, the shape and configuration of the mounting bracket is in no way intended to be limited to that illustrated. For example, the receiving face 220 and the interior face 250 may be a single face so that the mounting bracket 200 was pyramid shaped (a triangular cross section). Additionally, the mounting bracket 200 need not be screwed to the wall but could be connected in numerous manners that are either permanent, semi-permanent (removable) or temporary. For example, the mounting bracket 200 could be connected to the wall with nails, tape, glue, or Velcro.

Figure 3:
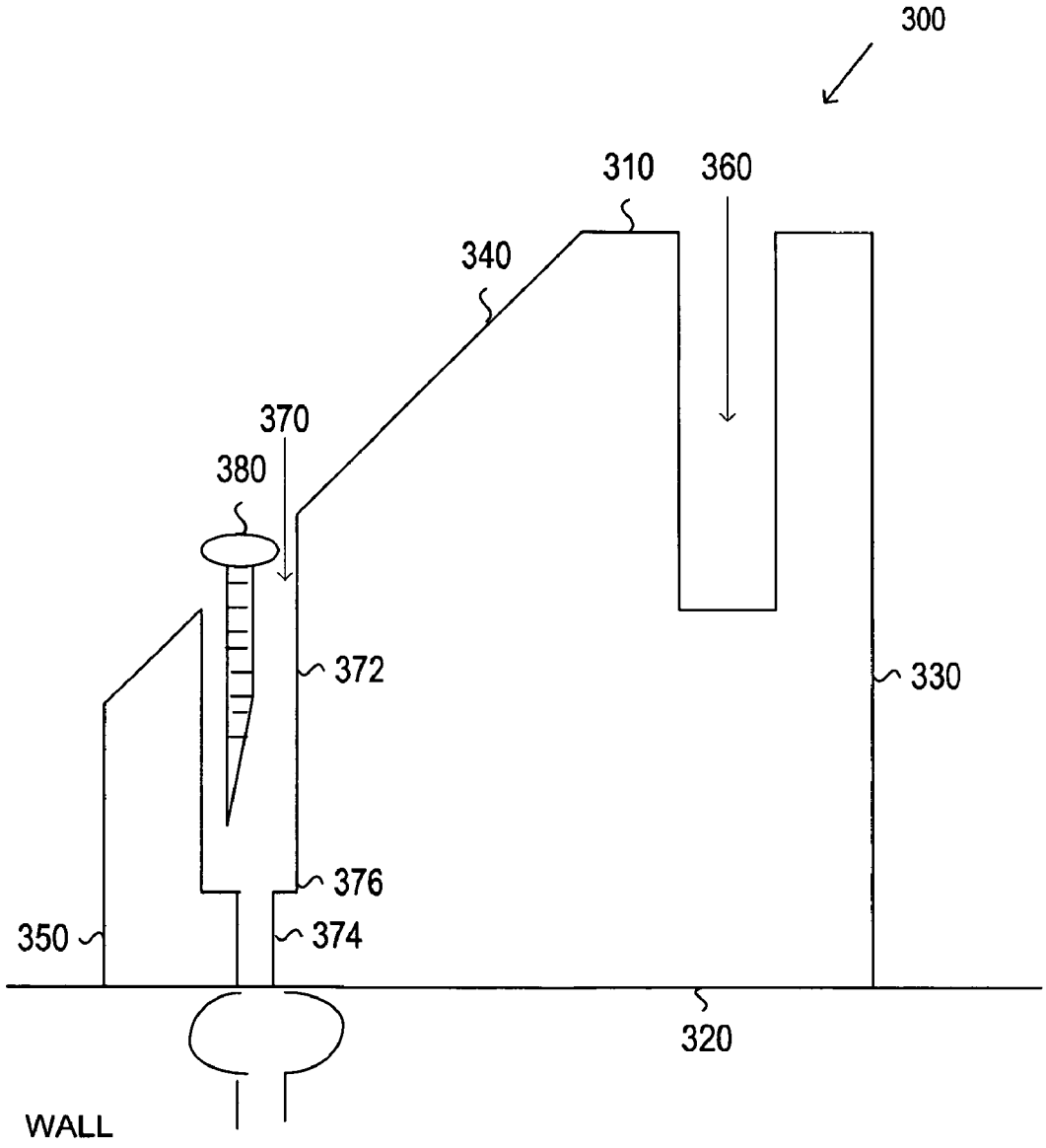
FIG. 3 illustrates a cross sectional top view of an example mounting bracket, according to one embodiment.

FIG. 3 illustrates a cross sectional view of an exemplary mounting bracket 300 (e.g., 200). The mounting bracket 300 includes a receiving face 310 (e.g., 220), a mounting face 320 (e.g., 230), a front face 330 (e.g., 240), a slanted connection face 340 (e.g., 250), and rear face 350. In this embodiment, the receiving face 310 and the mounting face 320 are parallel and the front face 330 and the rear face 350 are parallel. The rear face 350 is shorter than the front face 330 and the receiving face 310 is shorter that the mounting face 320 and the slanted face 340 connects the two shorter faces (rear 350 and receiving 310). This embodiment provides a symmetrical exterior.

The receiving face 310 has a groove 360 formed therein for receiving a shower bar. The slanted face 340 has a hole 370 formed therein that extends through the mounting bracket 300 and exits the mounting face 320. The hole 370 may receive a screw 380 to secure the mounting bracket 300 to a wall. The hole 370 includes a wide portion 372 and a narrow portion 374, and has a ledge 376 formed between the two. The screw threads can pass all the way through the hole 370 into the wall while the head of the screw may pass through the wide portion 372 but can not pass throw the narrow portion 374 so it comes to rest on the ledge 376. This embodiment allows the screw to be counter sunk (or recessed) within the slanted face 340. According to one embodiment, filler caps (not illustrated) may be provided that fit within the holes 370 to cover the screw head.

According to one embodiment, a set screw (not illustrated) is included that can be used to hold the bar within the groove 350. The set screw could be placed on an upper or lower surface (not illustrated) of the mounting bracket 300. Alternatively, the set screw may be placed in the front face 330 or the inner face 340.

According to one embodiment, the bar may be adjusted within the groove 360. The grove 360 may have a width and height that is wider and longer then the width and height of the bar to accommodate any necessary adjustments and/or so that the bar need not be inserted at an exact angle. For example, if the walls to which the mounting bracket 300 connect are not level the groove 360 may not be perfectly straight. If the shower walls to which the mounting brackets 300 are to be connected are not parallel the grooves 360 in each mounting bracket 300 may not be at the same angle. If the mounting brackets 300 were not installed at the same height and/or depth the bar would enter each groove 360 at a different angle.

The mounting bracket 300 may be made of a light weight but sturdy material. For example, the mounting brackets 300 may be made of white metal such as zinc powder. Alternatively, the mounting brackets 300 may be made of plastic. The mounting bracket 300 may be cast molded. Alternatively, the mounting bracket may be machined or injected. The mounting bracket 300 may be plated and/or lacquered. The mounting bracket 300 may be designed so the same bracket can be used to support either end of the shower bar (e.g., the left and right brackets are identical). The mounting brackets 300 may be solid with the only open area in the bracket being the groove and the holes or may be partially hollow.

Figure 4:
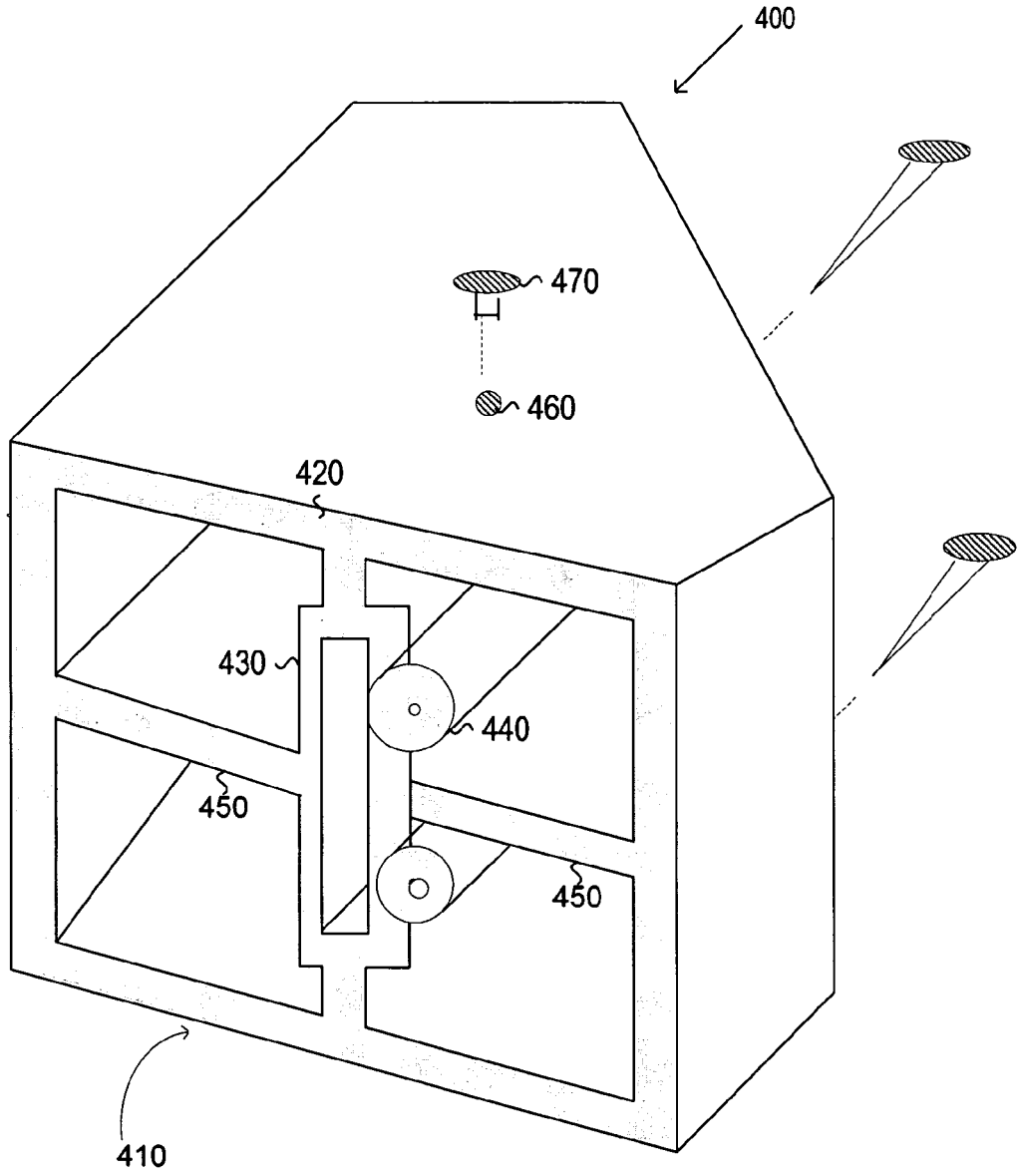
FIG. 4 illustrates a perspective view of an example mounting bracket, according to one embodiment.

FIG. 4 illustrates a perspective view of an example partial hollow mounting bracket 400. The mounting bracket 400 may include a mounting face 410 having an exterior surface 420, groove walls 430, screw hole walls 440, and supports 450. A partially hollow bracket 400 may be light weight while still providing the necessary support. The mounting bracket 400 may also include a set screw hole 460 for installing a set screw 470. The set screw hole 460 may enable the set screw 470 to enter the grove and hold the bar in place. The partial hollow mounting bracket 400 is in no way limited to the illustrated embodiment. Rather as one skilled in the art would recognize, numerous variations of a partially hollow mounting bracket 400 would be within the scope of the current invention.

Figure 5A:
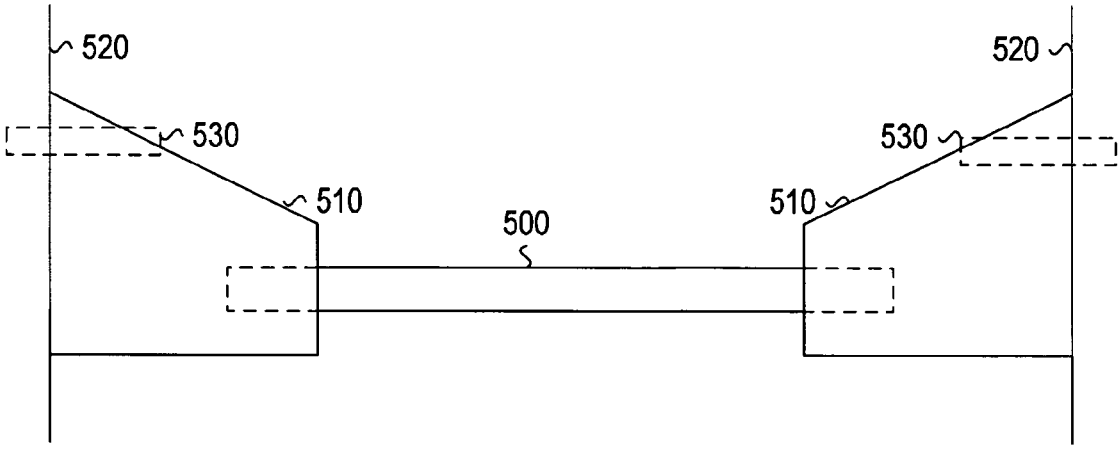
FIGS. 5A-B illustrate top views of an example shower bar installation between two parallel walls, according to one embodiment.
Figure 5B:
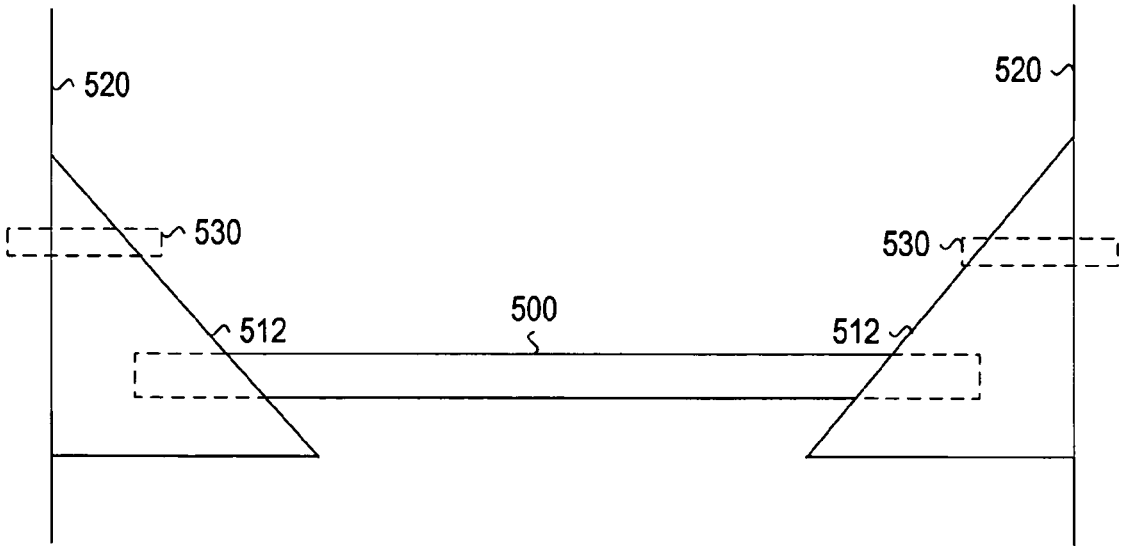

FIGS. 5A-B illustrate several different example shower bar/mounting brackets embodiments connected to two parallel (or near parallel) sidewalls. FIG. 5A illustrates a shower bar 500 secured by mounting brackets 510 connected to two parallel sidewalls 520 with screws 530. The mounting bracket 510 includes four sides with the screws 530 being inserted from an inside face to a mounting face. FIG. 5B illustrates a mounting bracket 512 having three sides. The bar 500 and the screws 530 enter the mounting bracket 512 on a single face (internal face that diagonally connects exterior face and mounting face). As one skilled in the art would recognize numerous other embodiments could be used for installing the shower bar between parallel sidewalls and various other mounting bracket configurations could be used without departing from the current scope.

Figure 5C:
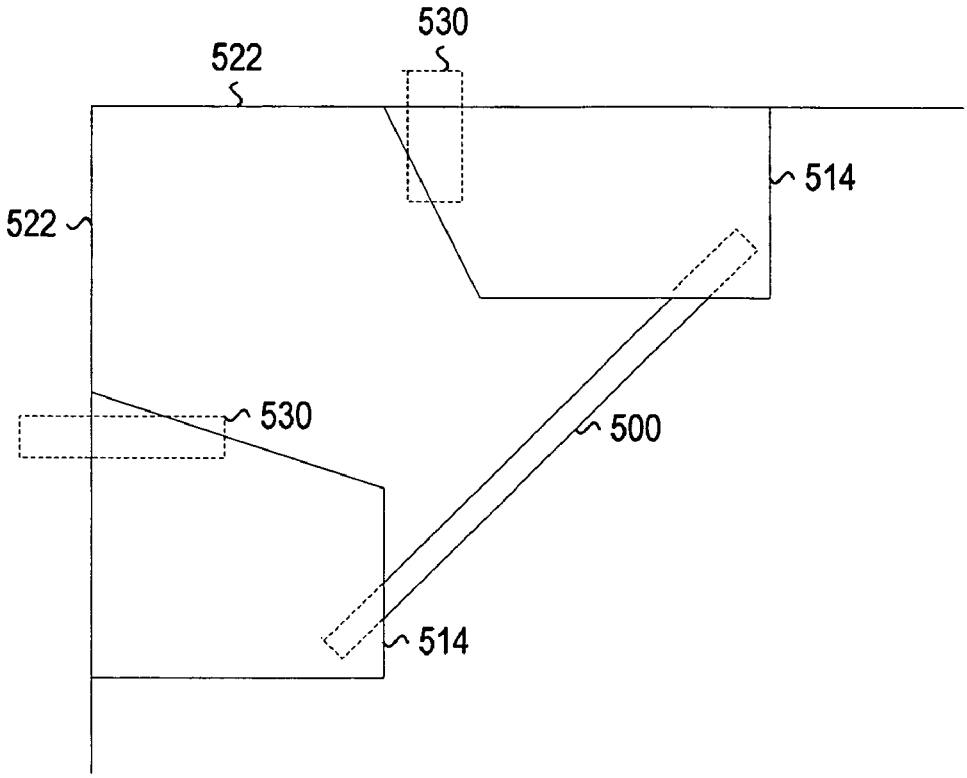
FIGS. 5C-D illustrate top views of an example shower bar installation between two perpendicular walls, according to one embodiment.
Figure 5D:
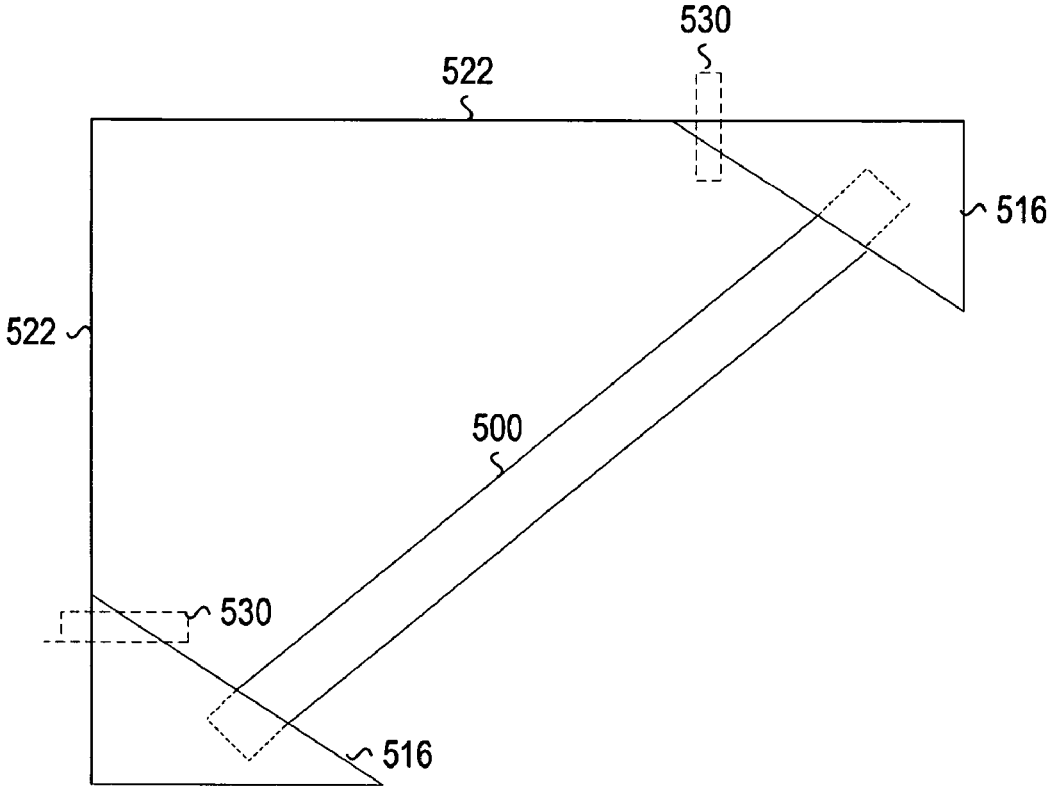

FIGS. 5C-D illustrate several different example shower bar/mounting brackets embodiments connected to two perpendicular (or near perpendicular) walls 522. In these embodiments, a shower curtain hanging from the shower bar 500 may act as the third wall of a shower stall. FIG. 5C illustrates a four sided mounting bracket 514 having a groove formed in a receiving face at an angle to receive the bar 500. FIG. 5D illustrates a three sided mounting bracket 516 where the bar 500 and screws enter a single interior face. The groove is at an angle to receive the bar 500. As one skilled in the art would recognize numerous other embodiments could be used for installing the shower bar between parallel sidewalls and various other mounting bracket configurations could be used without departing from the current scope.

The embodiments of FIGS. 5A-D included a straight bar 500. A straight bar may not always be desired. In some embodiments a curved bar may be desired. For example, a bathtub that is used as a shower may have a curved shape to the opening of the tub (e.g., tub is wider at center then at ends). A straight shower bar aligned with the narrower ends of the tub may result in lost shower area as the shower curtain will be draped in the shower as opposed to along the wall of the tub at the center point. Conversely, aligning a straight shower bar with the center of the tub may result in the shower curtain draping outside the tub at the ends, thus allowing water to run down the shower curtains outside the tub. Accordingly, a shower bar that was curved to follow (or reasonably follow) the curvature of the tub would be desired. Utilizing a curved shower bar may enable the shower curtain to drape substantially along the edge of the tub, which may enable an individual to utilize the entire tub while at the same time maintaining water within the tub. Moreover, a curved shower bar may provide additional room when it is used as a third wall between two perpendicular walls. A curved shower bar may also be used when only a single wall is available with which to mount the shower bar. Furthermore, a curved shower bar may look aesthetically pleasing regardless of what configuration it is used (between two parallel walls, between two perpendicular walls, or connected to a single wall).

Figure 6A:
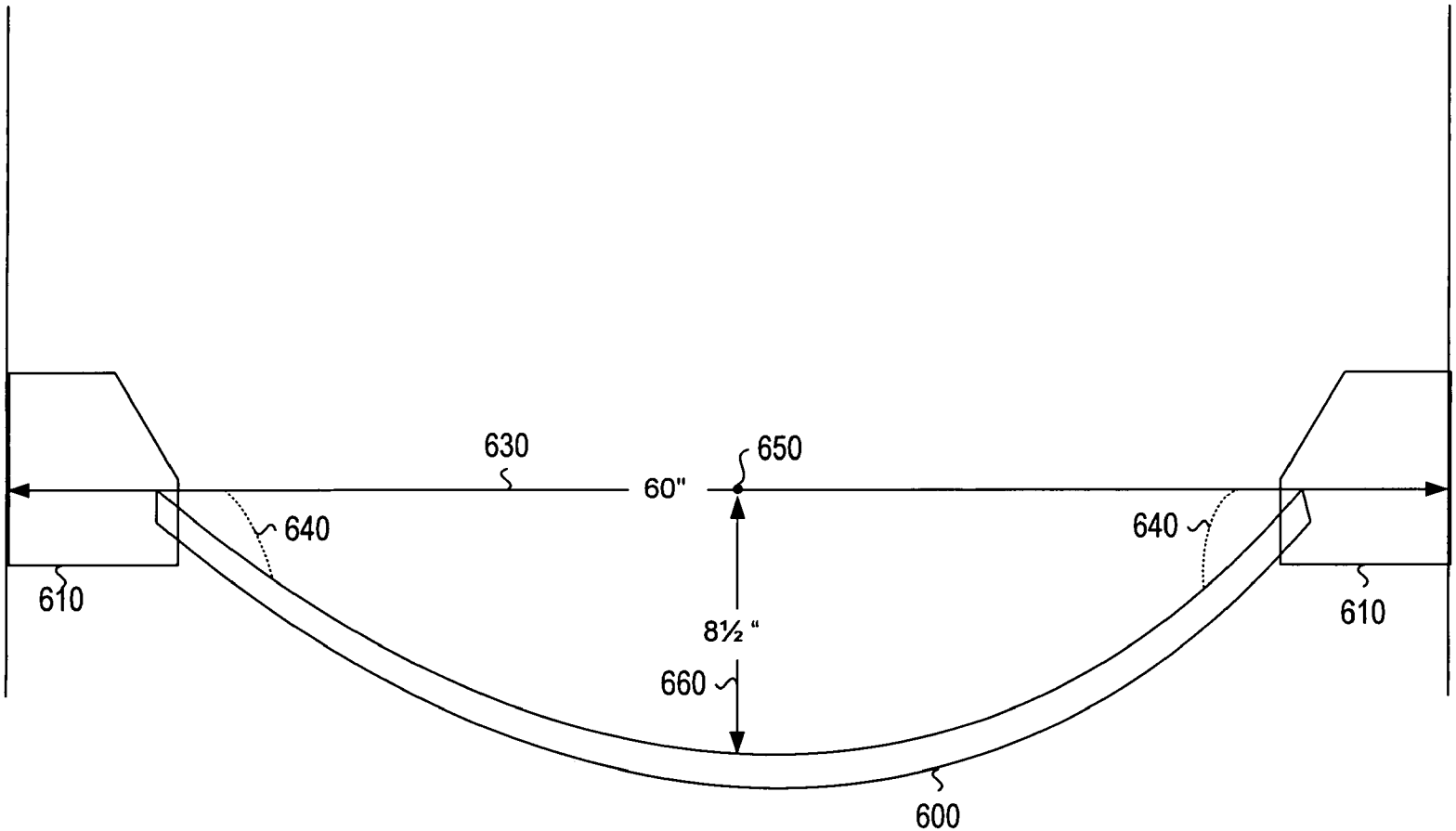
FIG. 6A illustrates a top view of an example curved shower bar installation between two parallel walls, according to one embodiment.

FIG. 6A illustrates an example curved shower bar 600 secured by mounting brackets 610 connected to two parallel sidewalls 620. An opening of the shower (distance between sidewalls) 630 will be a certain length. For example, a typical tub may have an opening of approximately 60 inches. The shower bar 600 is curved so that it extends from each of the sidewalls 620 (mounting brackets 610) at an angle 640. At a center point 650 of shower opening 630 (and the shower bar 600), the shower bar 600 will be extended a maximum distance 660 (e.g., 8 and ½ inches). The curved shower bar 600 has an overall length that takes into account opening 630, angle 640 (arc of the bar 600), and extended distance 660.

The shower opening 630 and the curvature of the tub will dictate the arc (angle) 640, the maximum distance 660, and accordingly the overall length of the shower bar. According to one embodiment, the curved shower bar 600 can be made to fit certain standard sized tubs. As illustrated, the exemplary shower bar 600 is designed to fit a tub that has an opening 630 of approximately 60 inches (from wall to wall) and has an edge that extends out a maximum distance 660 of approximately 8 and ½ inches. Accordingly, the angle 640 may be approximately 30 degrees and the overall length may be approximately 63 inches. However, the invention should in no way be construed to be limited to the embodiment illustrated. As previously mentioned, variations of these parameters are well within the scope of the current invention. As one of ordinary skill in the art would recognize, specifications of the bar (e.g., amount of curvature (arc), length) are dependent on size and shape of the tub.

The bar 600 may be made of the same materials and in the same fashion as the bar 100 of FIG. 1. According to one embodiment, the bar 600 may be made of a material that is flexible so that the arc 640 of the bar can be modified during installation in the event that any parameters vary (e.g., non-parallel walls, mounting brackets not mounted evenly, different tub opening length 630, different tub curvature). According to one embodiment, the bar 600 may come prefabricated in an arc shape to closely follow the edge of a tub. The bar 600 may come in one of several prefabricated shapes that correspond to different tub sizes and shapes. According to one embodiment, the arc 640 and maximum distance 660 can be changed by shortening the overall size of the bar 600 (e.g., cut ½ inch off of either end of the bar to reduce the maximum distance 660 by 1 inch). According to one embodiment, the bar may come straight and be bent to the specific application for which it is installed. According to one embodiment, the mounting brackets have several groves that can be used to install the bar at various arcs.

Figure 6B:
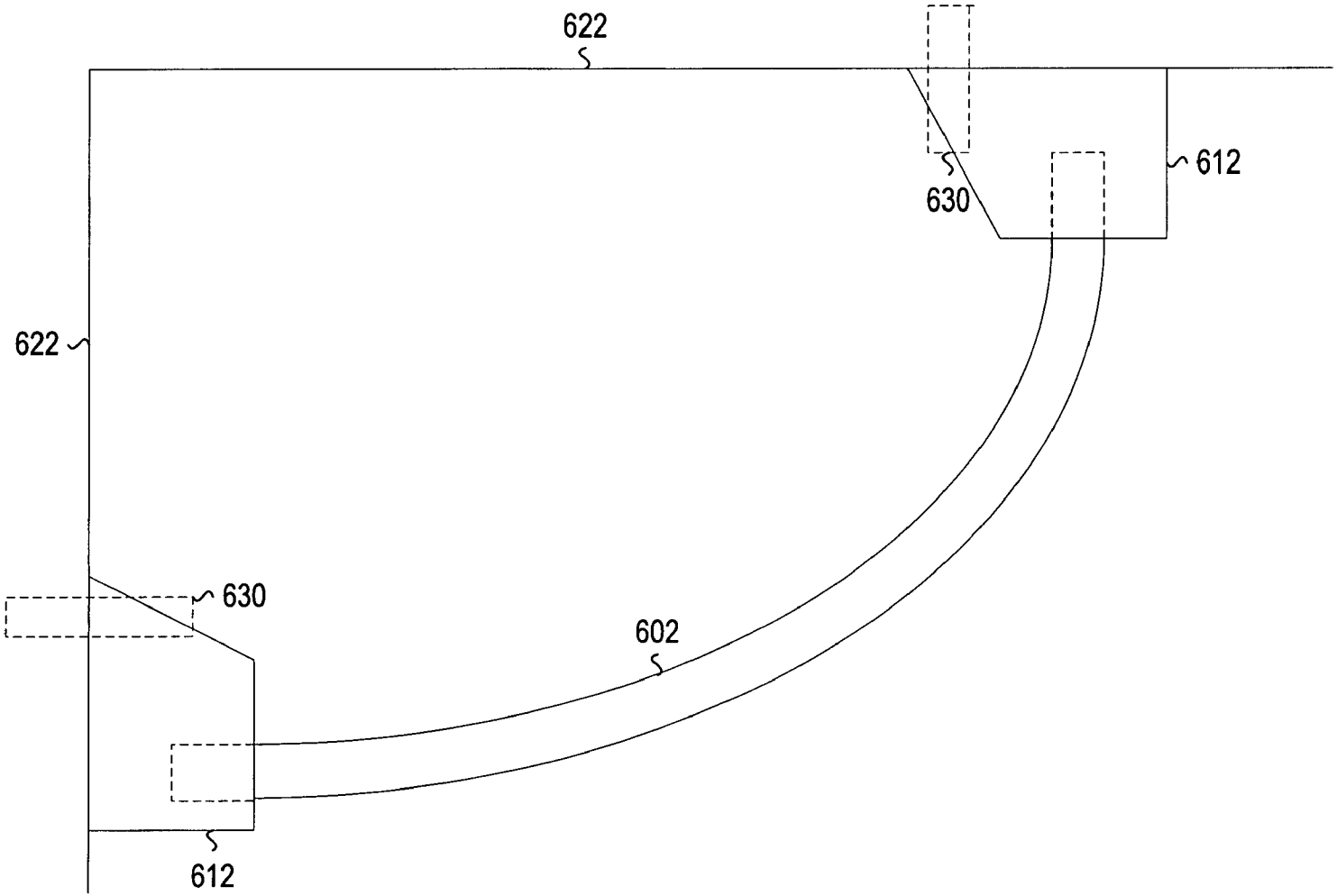
FIG. 6B illustrates a top view of an example curved shower bar installation between two perpendicular walls, according to one embodiment.

FIG. 6B illustrates an example curved shower bar 602 secured by mounting brackets 612 connected to two perpendicular walls 622. The curved bar 602 provides an individual taking a shower with additional room. A grove in the mounting bracket 612 may be at a particular angle to support a particular arc to the bar 602. That is, referring back to FIG. 3 the groove 360 in the receiving face 310 may extend at an angle (e.g., towards the rear face 350, parallel to the slanted connection face 340).

Figure 6C:
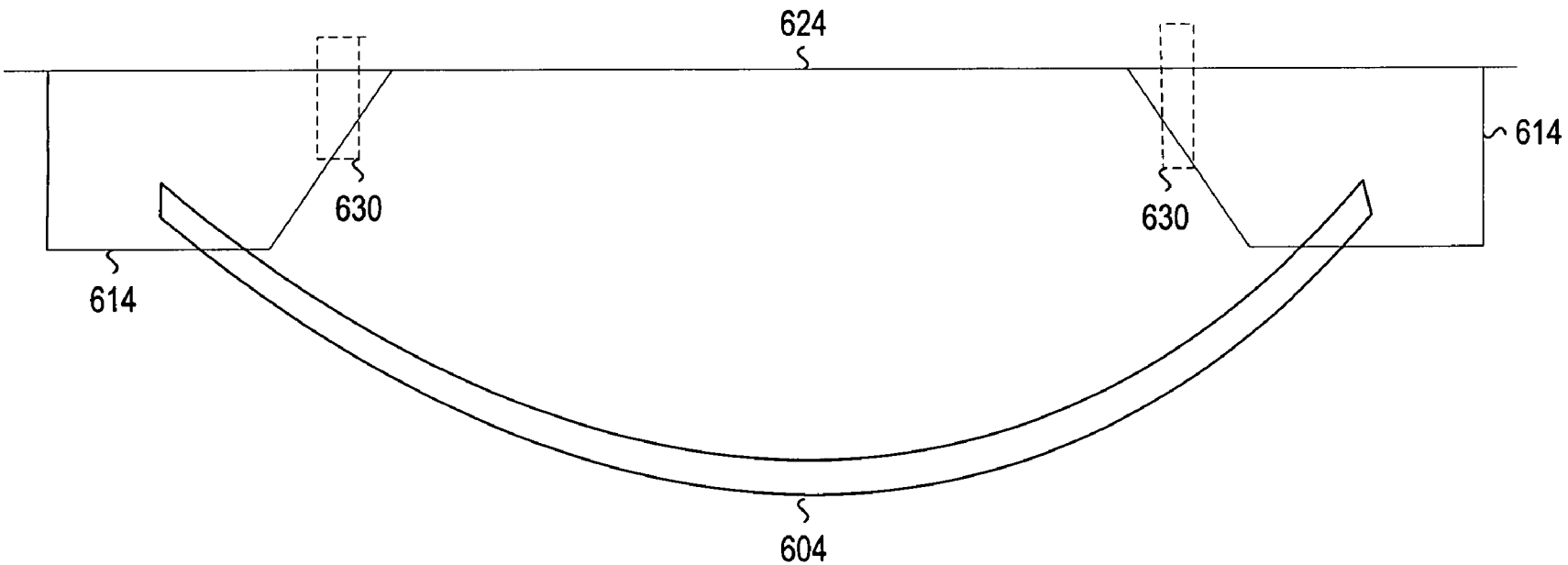
FIG. 6C illustrates a top view of an example curved shower bar installation connected to a single wall, according to one embodiment.

FIG. 6C an example curved shower bar 604 secured by mounting brackets 614 connected to a single walls 624. The curved bar 604 enables a shower curtain to be hung in tubs or shower enclosures that only have a single wall for mounting thereto without the need for supports from the ceiling. A groove in the mounting bracket 614 may be at a particular angle to support a particular arc to the bar 604.

The flat surface of the shower bar enables the bar to accommodate all types of shower curtains. Moreover, any type of fastening systems (e.g., hooks) can be used with the shower bar. In fact, the flat bar and curved upper end provides less friction that a standard shower bar so that shower curtains and/or fasteners slide easier on the shower bar. Moreover, using the shower bar enables the shower curtains to lay flat. When the shower curtain lays flat it gives the shower curtain a much cleaner and nicer look (e.g., the look of a drapes).

Figure 7A:
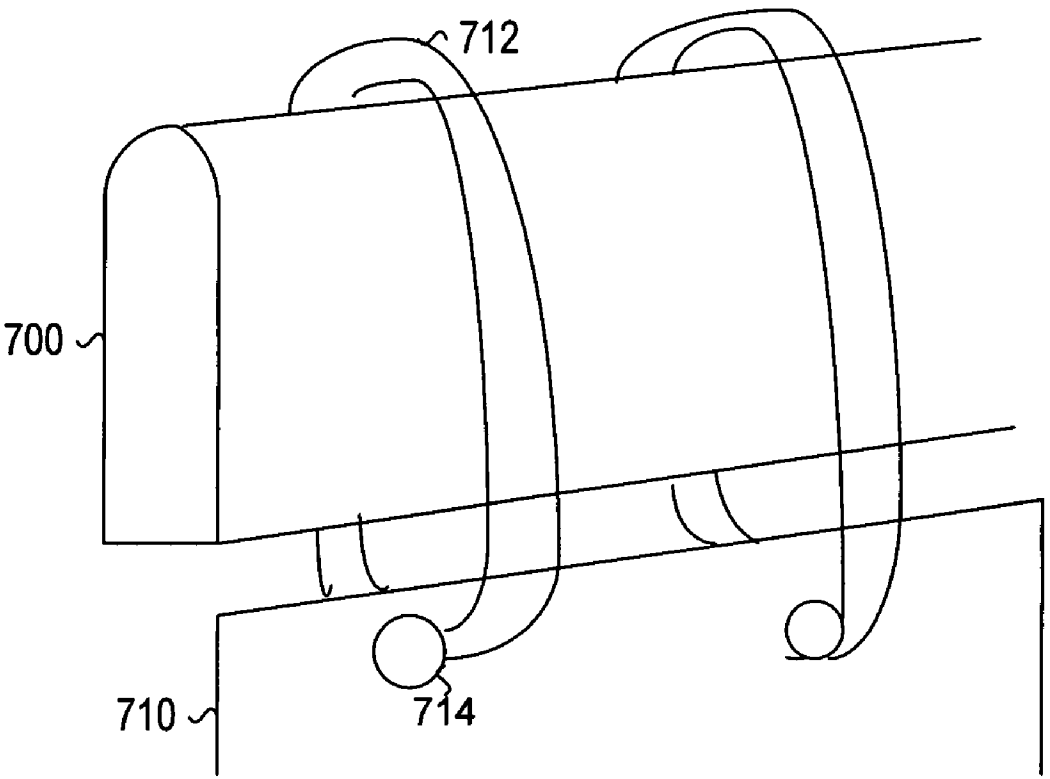
FIGS. 7A-C illustrate various types of curtains installed on an example shower bar, according to one embodiment.
Figure 7B:
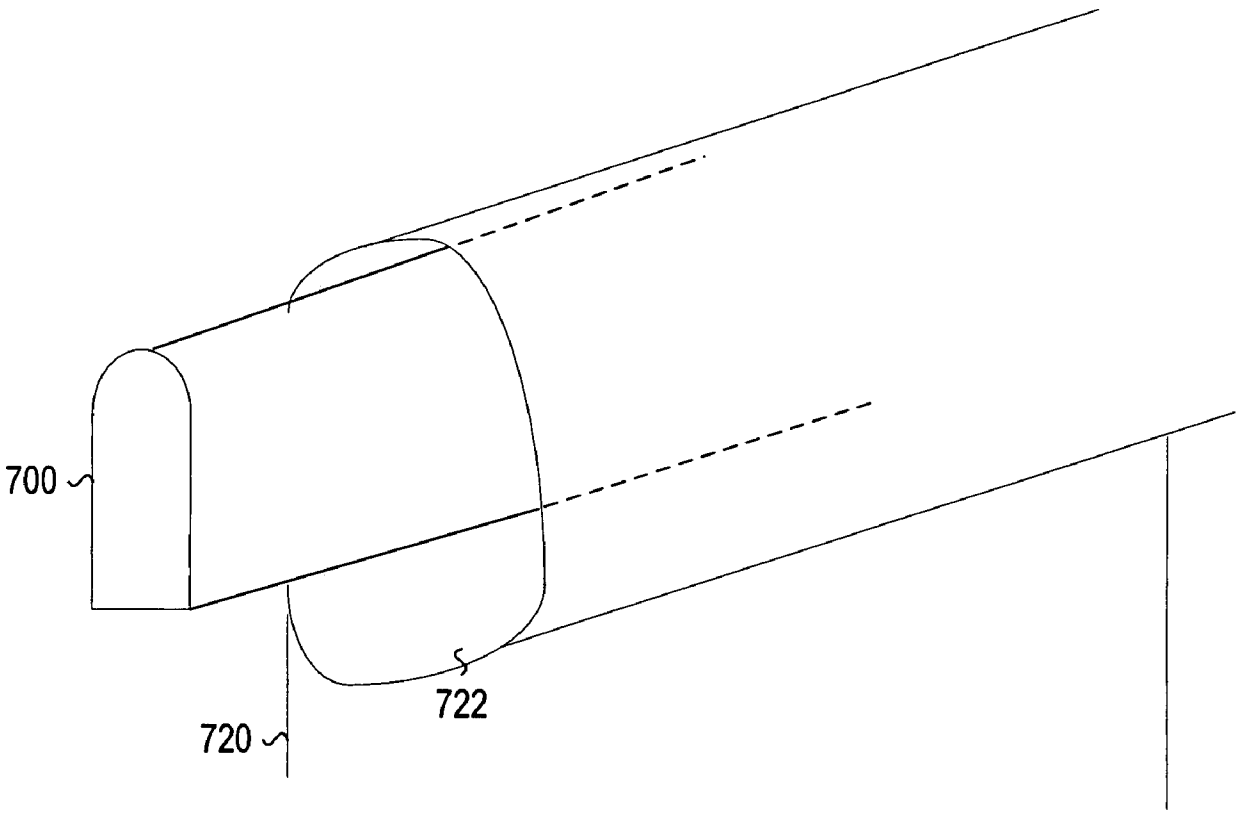
Figure 7C:
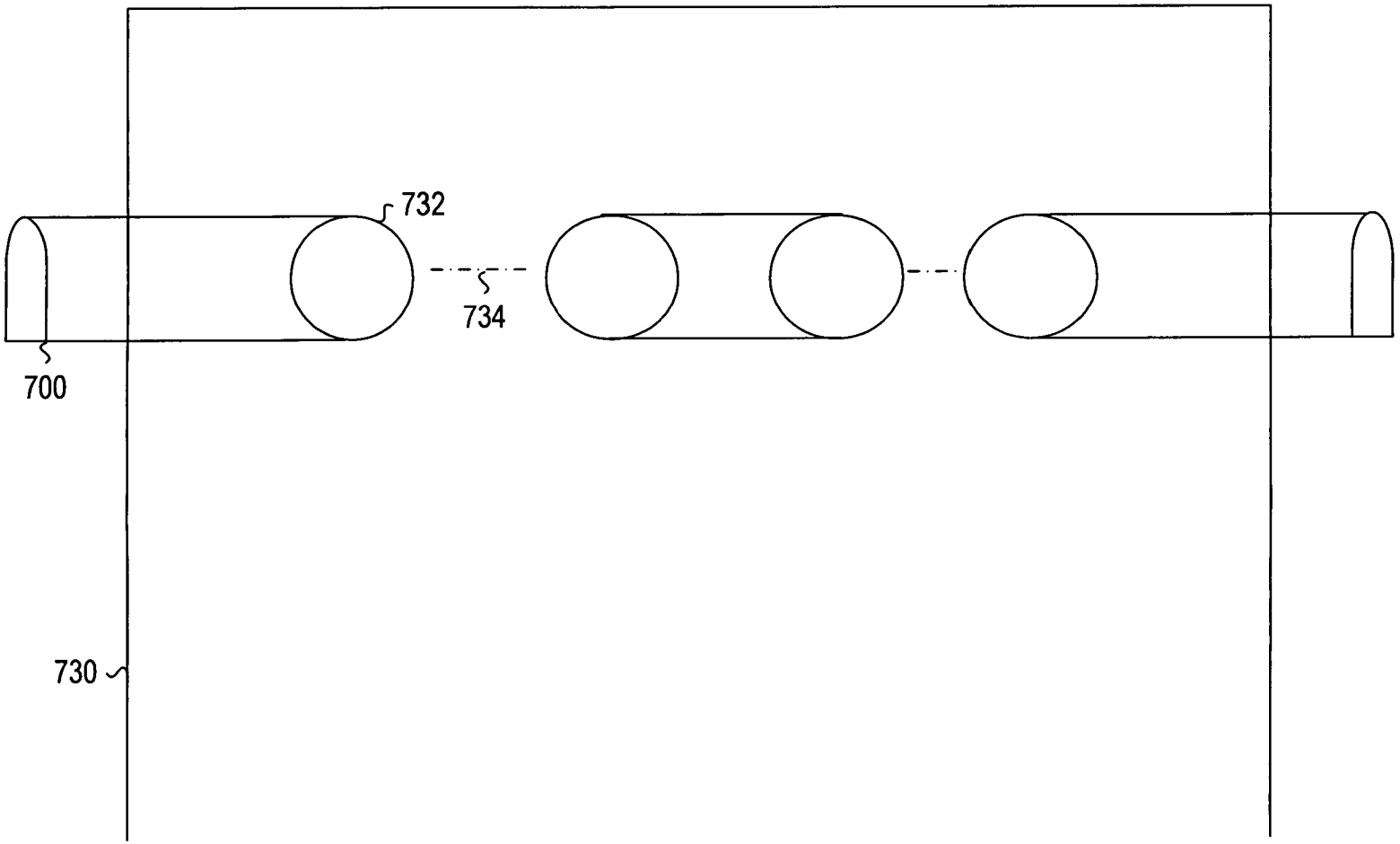

FIGS. 7A-C illustrate various types of shower curtains being connected to an exemplary shower bar 700. FIG. 7A illustrates a shower curtain 710 connecting to the shower bar 700 using standard hooks (rings) 712. The hooks 712 are inserted over the bar 700 and connect to the shower curtain 710 via eyelets 714 formed in the shower curtains 710. The hooks 712 may come in any number of sizes and shapes (circular, oblong, pear shaped). The hooks may be fully enclosed with one end connecting to the other via some sort of snap or clip, likely at the eyelet. Alternatively, the hooks may have be open with one end having a large end (possibly decorative) that will not go through the eyelet and the other end having a loop that goes around the shower bar. According to one embodiment, the hooks 712 may be an integral part of the shower curtains (e.g., stitched or glued in the shower curtain) so that the eyelets would not be required.

FIG. 7B illustrates a shower curtain 720 that has a pocket 722 formed therein. The bar 700 is inserted into the pocket 722 to hold the shower curtain 720. The pocket 722 may be a single pocket that extends across the whole shower curtain 720 or may be a series of pockets (if the packets are small enough they in effect become straps). The pocket 722 may be permanent (e.g., stitched) in which case the bar would need to be inserted threw the shower curtain 720 and then installed. Alternatively, the pocket 722 may be disconnectable (e.g., snap, Velcro®) so that the shower curtain 720 could be installed on the bar 700 while the bar 700 is in place.

FIG. 7C illustrates a shower curtain 730 (e.g., Hookless® shower curtain covered by U.S. Pat. No. 5,186,232) that has loops 732 formed therein and has slits 734 formed between alternating pairs of loops 732. The shower curtain can be installed over the shower bar 700 by popping the loops 732 connected by the slit over the shower bar 700 so that the loops 732 are now connected around the shower bar 700. After installation is complete, the shower bar will be in front of every other set of loops and behind every other set of loops 732. In an alternative embodiment, the loops 732 may be formed in a back layer of the shower curtain 730 and a front layer (e.g., valance) may cover the back layer so that you do not see the bar 700.

According to one embodiment, the bar (e.g., 100, 600) may be fabricated as a single piece and be packaged and sold that way. According to another embodiment, the bar may be fabricated in pieces so that it can be packaged in a more compact manner. The pieces may be connected together in any manner that would be known to one of ordinary skill in the art. For example, connecting pieces of the bar may have male and female pieces that can be connected or snapped together. The connecting pieces may include hooks that connect together. According to another embodiment, the bar may be one piece that is hinged in several locations and can thus be folded or bent so as to allow for more compact packaging.

According to one embodiment, the bar may come in decorative colors or have decorative designs formed thereon.

According to one embodiment, the mounting brackets may extend along the mounting wall to provide additional surface area for contact. The additional contact provides additional support to hold the bar in place as well as to help avoid the bar and/or brackets rotating.

Figure 8:
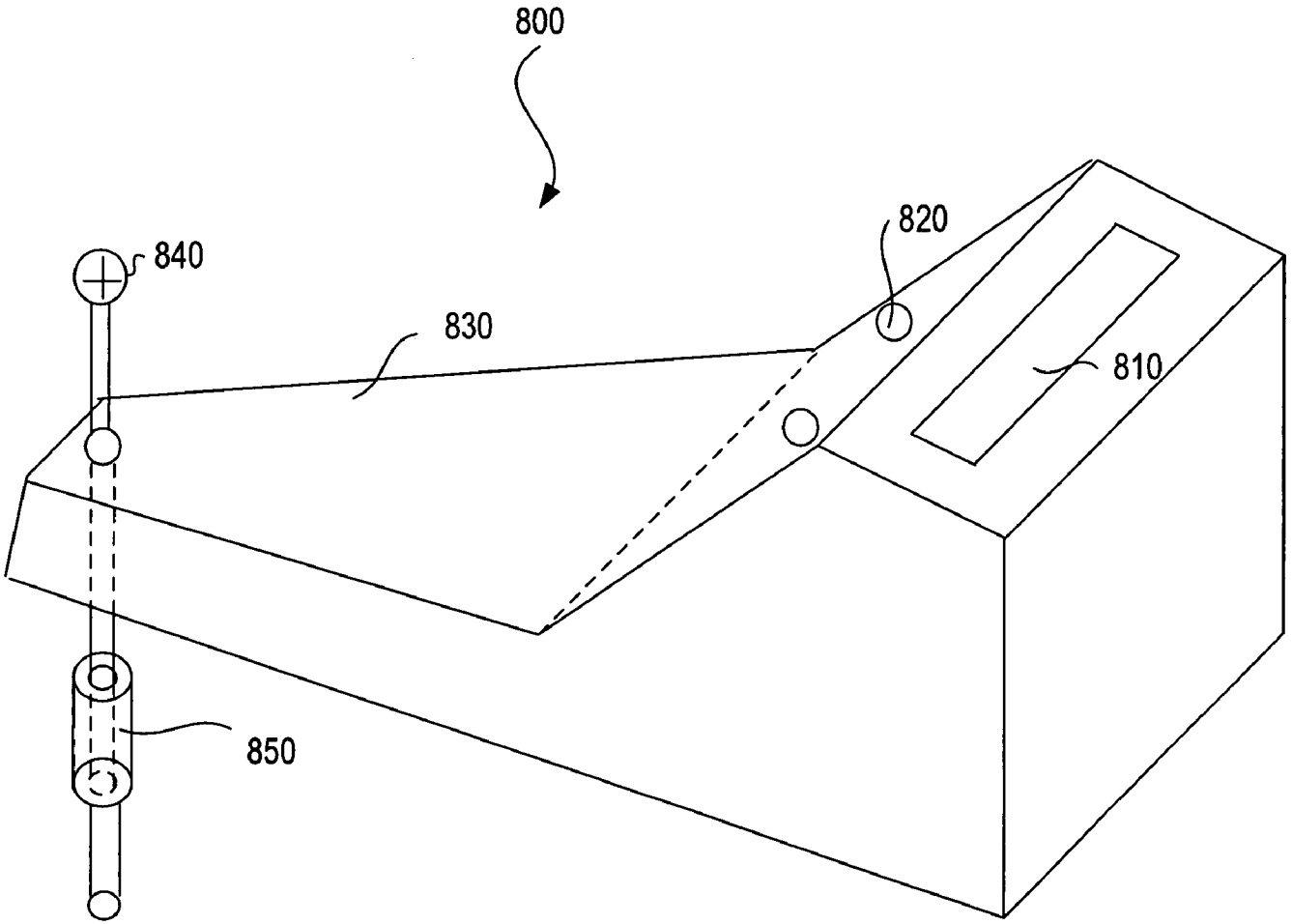
FIG. 8 illustrates a perspective view of an example mounting bracket, according to one embodiment.

FIG. 8 illustrates a perspective view of an example mounting bracket 800. The mounting bracket 800 includes a groove 810 formed in a receiving face and mounting holes 820 formed in a slanting face much like the mounting brackets discussed with respect to FIGS. 2 through 4. The mounting bracket 800 then includes an extension portion 830 that also extends a mounting surface. Within the extension portion 830 is another mounting hole 820 so that the mounting bracket 800 can be mounted at another point (three points are illustrated). It should be noted that the invention is not limited to the number of mounting holes 820 that are used to connect the mounting bracket 800 to the wall with screws or bolts. In fact, the mounting holes 820 and screws/bolts are not needed to connect the mounting bracket 800, as other means could be used (e.g., glue, Velcro®).

As previously mentioned, the mounting bracket connects to shower walls. The shower walls may be drywall, tile, and/or a tub insert. The mounting brackets may be bolted to the wall by using toggle bolts, molly bolts, anchors or other connection apparatus. Many of the connection apparatus require that a relatively large hold be drilled in the wall so that the connection apparatus (e.g., toggle bolt) can be inserted through the hole and then open within the wall to hold in place. If the shower wall is a tub insert, the large hall probably extends through the insert into the wall behind the insert so that the wall can provide the support as the tub insert is likely a thin material that can't provide the support for the mounting brackets itself. Bolting the mounting brackets to the wall behind the tub insert is likely to create stresses on the insert. According to one embodiment, inserts (e.g., polypropylene) can be used to provide support for the tub insert.

FIG. 8 illustrates the use of exemplary bolts (or screws) 840 and inserts 850 to mount the mounting bracket 800 to a tub insert. The inserts 850 may have an exterior diameter the size of the hole that needs to be drilled in the tub insert, may be as long as the gap between the tub insert and the wall, and have a hole formed therein for receiving the screw (or bolt) 840. The inserts 850 may act as a mechanical surface that distributes loads and resists torsioning, thus reducing stress on the tub insert. Moreover, the inserts 850 may provide a guide for the bolt 840. The inserts 850 may be separate pieces that are inserted over the bolt 840 during installation. Alternatively, the inserts 850 may be mounted to the mounting brackets 800.

The many features and advantages of the various embodiments are apparent from the detailed specification. Thus, the appended claims are intended to cover all such features and advantages of the various embodiments that fall within the true spirit and scope of the various embodiments. Furthermore, since numerous modifications and variations will readily occur to those skilled in the art, it is not desired to limit the various embodiments to the exact construction and operation illustrated and described. Accordingly, all appropriate modifications and equivalents may be included within the scope of the various embodiments.

Although the various embodiments have been illustrated by reference to specific embodiments, it will be apparent to those skilled in the art that various changes and modifications may be made which clearly fall within the scope. The embodiments are intended to be protected broadly within the spirit and scope of the appended claims.

What is claimed:

1. An apparatus comprising:

a pair of mounting brackets to mount to one or more shower walls, wherein the mounting brackets have a vertical groove formed therein having a rectangular cross section, wherein the grooves are at an angle extending outwards from a straight line between the mounting brackets mounted to the one or more shower walls, wherein each mounting bracket includes a mounting face to abut the shower wall, a front face extending substantially perpendicular from the mounting face, a receiving face extending substantially perpendicular from the front face so as to be substantially parallel to the mounting face, wherein the receiving face is shorter than the mounting face, and a inner face extending between the receiving face and the mounting face, wherein the receiving face has the vertical groove formed therein extending from the receiving face toward the mounting face at an angle, wherein the angle is away from the front face, and wherein the inner face has holes formed therein that extend through the mounting surface to accept screws for mounting the mounting brackets to the shower walls; and a bar having a rectangular cross section that is less than the rectangular cross section of the grooves, wherein the bar has a continuous angle of curvature formed therein, wherein the bar is made of a flexible material that enables the bar to be flexed including along the angle of curvature, wherein the bar is to be inserted in the groove with the bar curving outward from the straight line between the mounting brackets, wherein the angle of curvature within the groove provides a tension that supports the bar in a substantially vertical plane to a shower floor, and wherein the vertical groove keeps the bar from twisting.

2. The apparatus of claim 1, wherein configuration of the mounting brackets with respect to each other defines configuration of the bar therebetween.

3. The apparatus of claim 2, wherein the configuration of the bar therebetween includes distance the bar extends outward from the straight line between the mounting brackets and arced shape of the bar therebetween.

4. The apparatus of claim 2, wherein the configuration of the mounting brackets includes arrangement of the shower walls that the mounting brackets are mounted to, alignment of the mounting brackets with respect to each other, and distance separating the mounting brackets.

5. The apparatus of claim 2, wherein the continuous angle of curvature of the bar enables length of the bar to be shortened while maintaining the continuous angle of curvature by cutting a single end of the bar, and wherein the length of the bar further defines the configuration of the bar between the mounting brackets.

6. The apparatus of claim 1, wherein the tension on the bar within the groove enables distance between mounting brackets to be reduced while still retaining the outward curvature of the bar from the straight line between the mounting brackets by reducing length of the bar, wherein the length can be reduced by cutting only one end of the bar.

7. The apparatus of claim 1, wherein the tension on the bar within the groove enables distance the bar extends outward from the straight line between the mounting brackets to be reduced by reducing length of the bar, wherein the length can be reduced by cutting only one end of the bar.

8. The apparatus of claim 1, wherein the vertical groove keeps the bar having a rectangular cross section from twisting.

9. The apparatus of claim 1, further comprising inserts, wherein the shower walls include tub insert walls and wherein the mounting brackets are secured to the shower walls through the tub insert walls, and wherein the inserts are placed between the mounting brackets and the shower walls to provide support to the tub insert walls.

10. The apparatus of claim 1, wherein each of the mounting brackets is a single piece.

11. The apparatus of claim 1, wherein the tension created between the grove and the bar and the flexible nature of the bar enable the apparatus to be installed in various configurations.

12. The apparatus of claim 11, wherein the various configurations include arrangement of the shower walls that the mounting brackets are mounted to, alignment of the mounting brackets with respect to each other, and distance separating the mounting brackets.

13. The apparatus of claim 1, wherein the holes formed in the inner face are counter sunk.

* * * * *